US008997443B2

(12) United States Patent
Corradi

(10) Patent No.: US 8,997,443 B2
(45) Date of Patent: Apr. 7, 2015

(54) APPARATUS AND A METHOD FOR REMOVING A WRAPPING FILM FROM A PACK OF OBJECTS

(75) Inventor: Cesare Corradi, Cadelbosco di Sopra (IT)

(73) Assignee: Clevertech S.p.A., Cadelbosco di Sopra (IT)

( * ) Notice: Subject to any disclaimer, the term of this patent is extended or adjusted under 35 U.S.C. 154(b) by 702 days.

(21) Appl. No.: 13/298,959

(22) Filed: Nov. 17, 2011

(65) Prior Publication Data

US 2012/0131889 A1 May 31, 2012

(30) Foreign Application Priority Data

Nov. 25, 2010 (IT) ..... PR2010A0087

(51) Int. Cl.
*B65B 43/26* (2006.01)
*B65B 69/00* (2006.01)

(52) U.S. Cl.
CPC ..... *B65B 69/0066* (2013.01); *B65B 69/00* (2013.01)

(58) Field of Classification Search
CPC ..... B65B 60/0066; B65B 60/00; B65B 43/26
USPC ..... 53/492, 384.1, 381.1; 225/1; 428/35.2
See application file for complete search history.

(56) References Cited

U.S. PATENT DOCUMENTS

| | | | | |
|---|---|---|---|---|
| 8,117,733 | B2 * | 2/2012 | Reggiani et al. | 29/564.3 |
| 2002/0162302 | A1 * | 11/2002 | Thomson et al. | 53/492 |
| 2002/0162303 | A1 * | 11/2002 | Skrak et al. | 53/492 |
| 2009/0261139 | A1 | 10/2009 | Reggiani et al. | |
| 2009/0282787 | A1 * | 11/2009 | Pippin | 53/492 |
| 2010/0218458 | A1 * | 9/2010 | Benini et al. | 53/381.2 |
| 2011/0000171 | A1 * | 1/2011 | Daughtry | 53/492 |
| 2014/0053514 | A1 * | 2/2014 | Gess | 53/492 |

FOREIGN PATENT DOCUMENTS

| | | | |
|---|---|---|---|
| EP | 2 110 331 | A2 | 10/2009 |
| EP | 2 221 251 | A1 | 8/2010 |
| GB | 2 105 288 | A | 3/1983 |
| IT | PR20080024 | A | 10/2009 |
| JP | 2 166034 | A | 6/1990 |
| WO | 03/091115 | A1 | 11/2003 |
| WO | WO 2012099530 | A1 * | 7/2012 |

* cited by examiner

*Primary Examiner* — Michelle Lopez
(74) *Attorney, Agent, or Firm* — Pearne & Gordon LLP

(57) ABSTRACT

An apparatus for removing a plastic wrapping film from a pack of objects, comprising an opening station of the wrapping film. The opening station in turn comprising housing means of the pack identifying a housing seating of the pack. The opening station comprises weakening means of a part of the film. The weakening means comprising heating means of a fluid and a first outlet mouth and a second outlet mouth of the heated fluid, said first mouth and said second mouth being, at least in a configuration thereof:

operatively connected to said heating means of a fluid;
facing towards said housing seating;
facing towards an imaginary plane interposed there-between.

10 Claims, 5 Drawing Sheets

APPARATUS AND A METHOD FOR REMOVING A WRAPPING FILM FROM A PACK OF OBJECTS

FIELD OF THE INVENTION

This invention relates to an apparatus and a method for removing a wrapping film from a pack of objects.

DESCRIPTION OF THE KNOWN ART

An apparatus for removing a wrapping film from a pack of objects stacked along a first direction is described in the Italian patent application PR2008A000024. This wrapping extends along a main direction of extension between a first and a second end. Conveniently, the film is of heat-shrink type and has a greater thickness at the first and the second end than along the remaining part of the film.

The prior art apparatus comprises:

- a first and a second roller forming a first pair of rollers for longitudinally supporting the wrapping in a film removal station and connected to a first drive motor designed to rotate it around the axes;
- a third and a fourth roller forming a second pair of rollers, which are movable between a raised position, not interfering with the wrapping positioned in the removal station, and a lowered position, in which they press the top of the wrapping against the first and second roller;
- means for tearing the wrapping film positioned in the removal station, allowing the removal by the first pair of rollers.

The means for tearing the film comprise a second drive motor connected to the second pair of rollers for rotating them around the longitudinal axes so as to stretch portions of film positioned between the contact surfaces with the first and second pair of rollers, for causing the tearing.

The aforementioned prior art apparatus attempts to open the film at a weakened zone of the film, typically a sealing connection which extends between the first and the second end of the wrapping.

The Applicant has found that the level of accuracy of the sealing is now such that in many cases it no longer constitutes a weakened zone and the mere action of the first and the second pair of rollers does not guarantee the opening of the film.

Moreover, the Applicant has found that in some cases there is difficulty in opening the film at the first and the second end where the thickness is greater.

SUMMARY OF THE INVENTION

In this context, the technical purpose which forms the basis of this invention is to propose an apparatus and a method for removing a wrapping film that overcomes the above mentioned drawbacks of the prior art.

More specifically, the aim of this invention is to provide an apparatus and a method which allows the removal of the wrapping film to be improved.

The technical purpose indicated and the aims specified are substantially achieved by an apparatus and a method comprising the technical features described in one or more of the appended claims.

Further features and advantages of the invention are more apparent in the non-limiting description which follows of a preferred non-limiting embodiment of an apparatus and a method illustrated in the accompanying drawings, in which.

Figure 5:
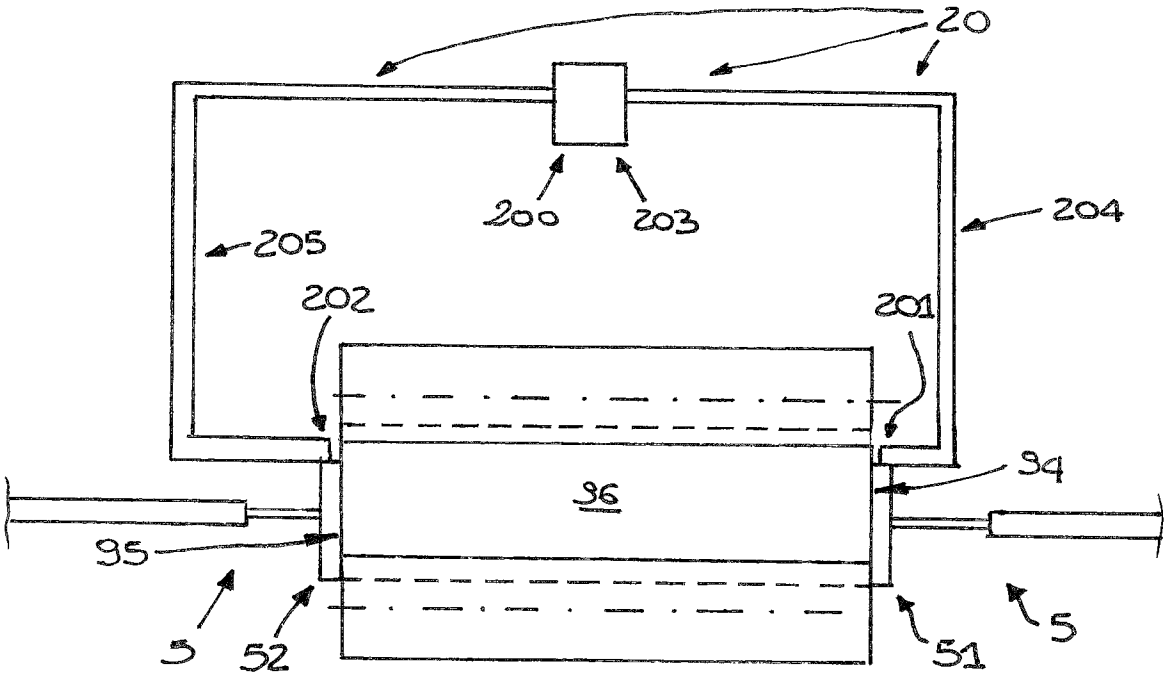
Figure 6:
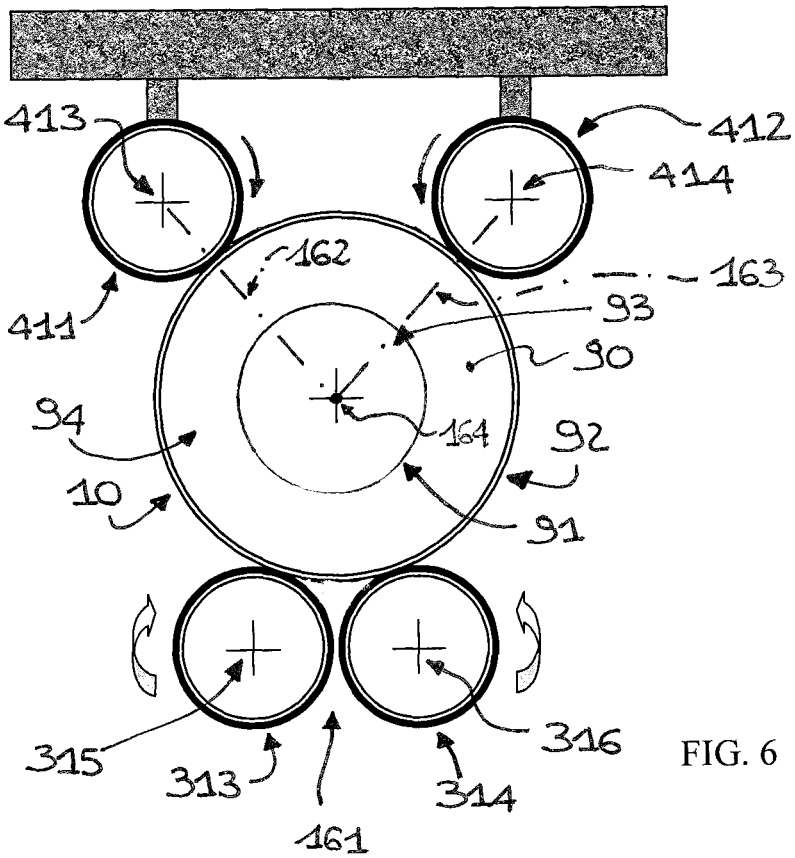
Figure 7:
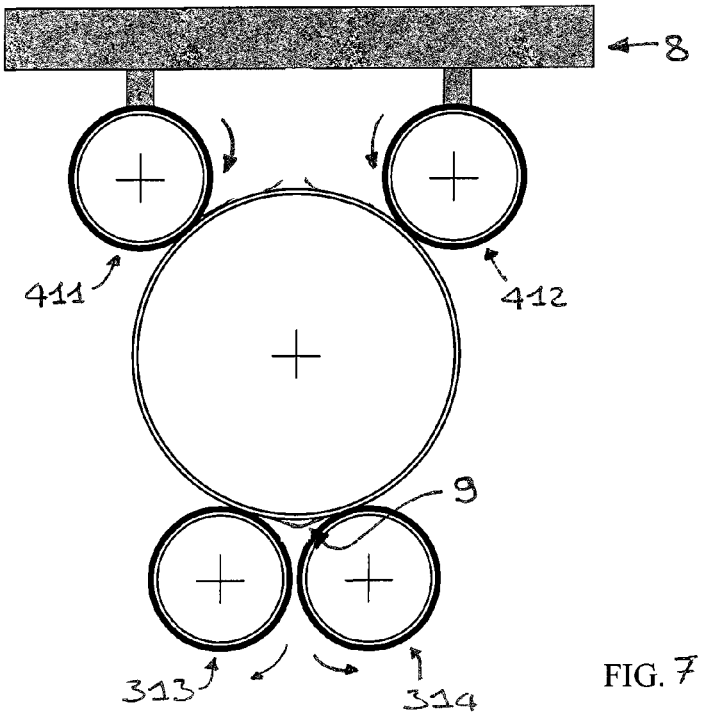
Figure 8:
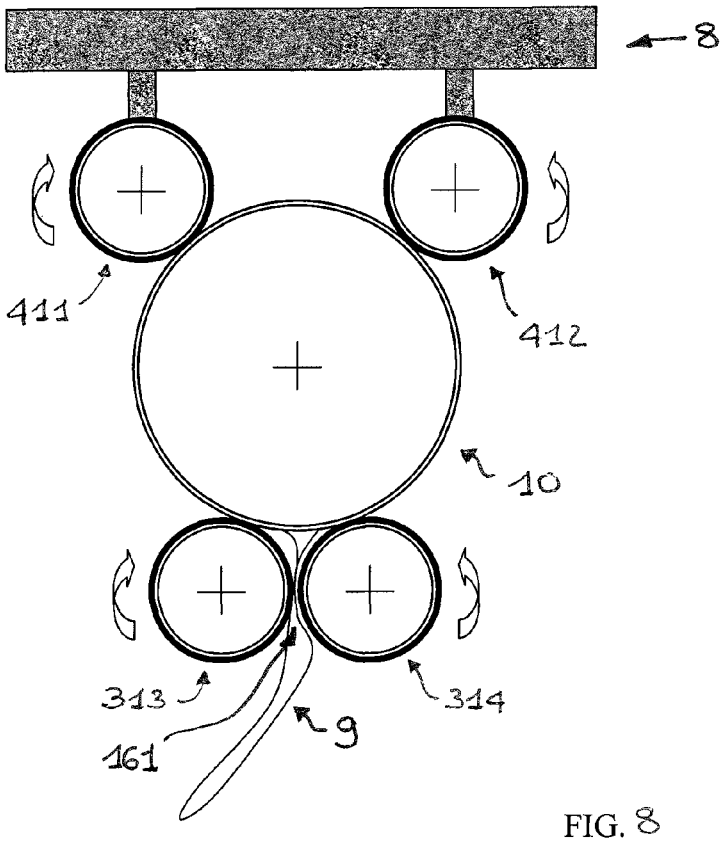

FIG. 5 schematically shows a construction detail of the apparatus according to this invention;

FIGS. 6, 7 and 8 schematically show a detail of the apparatus according to this invention in three different operating steps.

DESCRIPTION OF THE PREFERRED EMBODIMENTS

With reference to the accompanying drawings, the numeral 1 denotes an apparatus for removing a wrapping film from a pack of objects. Conveniently, the film is plastic. Conveniently, the pack has a main longitudinal direction of extension. In a typical application, the objects are covered placed side by side for forming a stack of objects adjacent to each other. This invention relates to packs generally having cylindrical geometry; however, it may also be applied to packs having different geometries, for example, packs with an elliptical or square cross-section. The plastic films used are generally heat-shrinking, wound around the series of objects and having two flaps sealed along a longitudinal line (coinciding substantially with one direction of the pack, in the case in which the pack has a substantially cylindrical form as in the case illustrated).

The apparatus 1 comprises a station 2 for opening the wrapping film of the pack.

The opening station 2 in turn comprises means 3 for housing the pack identifying a housing seating 30 of the pack. The housing means 3 comprise means 4 for tearing the wrapping film of the pack comprising a first pair of rollers 41 which may be positioned in contact with the pack. The rollers of the first pair of rollers 41 have rotation axes substantially parallel to a first direction 16 and at least in one configuration they are counter-rotating. Conveniently, the housing seat 30 develops preponderantly along the first direction 16.

The opening station 2 in turn comprises a compactor 5 comprising a first and a second element 51, 52 which are reciprocally nearable along the first direction 16 for longitudinally compressing the pack located in the housing seating 30 between the first and the second element 51, 52. The housing seat 30 is interposable between the first and the second element 51, 52. The compactor 5 allows the various objects of the pack to be kept together both during the operation for removing the film from the pack and during the subsequent movement as a unit from the housing seating 30.

The opening station 2 comprises means 20 of weakening a part of the film facing towards a first and a second element 51, 52. The weakening means 20 soften parts of the film facing planes at right angles to the first direction 16 and passing through the first and the second element 51, 52.

The weakening means 20 comprise means 200 for heating a fluid and a first and a second outlet mouth 201, 202 of the heated fluid. The first and the second mouth 201, 202 are:

- operatively connected to the means 200 for heating a fluid;
- facing towards the housing seating 30;
- facing towards an imaginary plane 160 interposed therebetween, the imaginary plane 160 being at right angles to the first direction 16 and intersecting the first pair of rollers 41. This allows the weakening of end portions of the wrapping film of the pack. The imaginary plane 160 is interposed between the first and the second element 51, 52. The first and/or the second outlet mouth 201, 202 are integrated into means of directing the heated fluid along the first direction 16.

The weakening means 20 comprise at least a first tubular conduit 204 which extends continuously from the heating means 200 to the first outlet mouth 201, the first outlet mouth 201 defining an end of the first tubular conduit 204. Conveniently, the first outlet mouth 201 is integral with the first element 51 of the compactor 5.

More specifically, the weakening means 20 also comprise a second tubular conduit 205 which fluid-dynamically connects the heating means 200 to the second outlet mouth 202, the second outlet mouth 202 defining an end of the second tubular conduit 205. Conveniently, the second tubular conduit 205 extends continuously from the heating means 200 to the second outlet mouth 202.

The second outlet mouth 202 is preferably integral with the second element 52 of the compactor 5. The directing means comprise an end portion of the first and the second tubular conduit 204, 205. The first and/or the second tubular conduit 204, 205 comprise at least one flexible stretch. The first and the second outlet mouth 201, 202 are supplied quickly by the heated fluid irrespective of the position adopted by the first or the second element 51, 52 of the compactor 5.

In the preferred embodiment the heated fluid is sent from the heating means 200 to the first outlet mouth 201 always remaining inside the first tubular conduit 204. Similarly, the heated fluid is sent from the heating means 200 to the second outlet mouth 202 always remaining inside the second tubular conduit 205. The first and the second tubular conduit 204, 205 may coincide in at least one stretch. Preferably, the first and the second outlet mouth 201, 202 respectively comprise an outlet section elongated along a predetermined direction.

Conveniently, the means 200 for heating a fluid comprise a single generator 201 of hot fluid (typically hot air) to which both the first and the second outlet mouth 201, 202 are connected (through the first and the second tubular conduit 204, 205).

The housing means 3 comprise a second pair of rollers 31 defining, in combination with the first pair of rollers 41, the housing seating 30 for housing the pack.

The first pair of rollers 41 comprises a first and a second roller 411, 412.

The second pair of rollers 31 comprises a third and a fourth roller 313, 314. The third and the fourth roller 313, 314 define interposed there-between a slit 161 for evacuating the wrapping film. The rotation axes of the first, the second, the third and the fourth roller 411, 412, 313, 314 are reciprocally parallel. Conveniently, the first and the second roller 411, 412 are cylindrical and have equal diameters. Similarly, the third and the fourth roller 313, 314 are also cylindrical and have equal diameters. Preferably, the diameter of the first and the third roller 411, 313 are equal. The distance between the first and the fourth roller 411, 314 is identical to the distance between the second and the third roller 412, 313.

A first plane passing through the rotation axes of the first and the third roller 411, 313 is defined and a second plane passing through the rotation axes of the second and the fourth roller 412, 314 is defined; the portion of the first plane interposed between the first and the third roller 411, 313, and the portion of the second plane interposed between the second and the fourth roller 412, 314 are without points in common. A horizontal ideal reference plane 15 is defined below the apparatus 1; the distance between the rotation axis 413 of the first roller 411 and the ideal horizontal reference plane 15 is greater than the distance between the rotation axis 315 of the third roller 313 and the ideal horizontal reference plane 15; the distance between the rotation axis 414 of the second roller 412 and the ideal horizontal reference plane 15 is greater than a distance between the rotation axis 316 of the fourth roller 314 and the ideal horizontal reference plane 15.

The apparatus 1 also comprises motorisation means of the first and the third roller 411, 313 in a first rotation direction and of the second and the fourth roller 414, 314 in a second rotation direction, opposite the first rotation direction. This allows stretching of the film interposed between the first and the second roller 411, 412.

Conveniently, the first and the second roller 411, 412 are operatively connected to a first same motor typically of the electric type. Conveniently, the third and the fourth roller 313, 314 are operatively connected to a second same motor typically of the electric type. Alternatively, the first, the second, the third and the fourth roller 411, 412, 313, 314 are operated by independent motors. The apparatus 1 also comprises an electronic card (not illustrated since it is of a known type; it should be noted that a PLC or other alternative known devices may be used instead of the electronic card) programmed for driving the first motor and/or the second motor.

Conveniently, the apparatus 1 comprises a frame to which the first and/or the second pair of rollers 41, 31 is connected. The second pair of rollers 31 is designed to support the weight of the pack of objects positioned in the opening station 2.

Conveniently, the apparatus 1 comprises means 8 for moving the first pair of rollers 41 between a first position in which the first pair of rollers 41 is closer to the second pair of rollers and a second position in which it is moved away from the second pair of rollers 31.

In the first position the first pair of rollers 41 compresses the pack positioned in the housing seating 30 against the second pair of rollers 31. In the second position the pack may be inserted and removed from the housing seating 30.

Conveniently, the apparatus 1 comprises means for pressing the third roller 313 and the fourth roller 314 against each other (for example, the means for pressing the third and the fourth roller 313, 314 comprise fluid-dynamic pistons).

The apparatus 1 also comprises, originally, a sensor (not illustrated) connected to an actuator of the pneumatic pistons and operating on them for measuring, directly or indirectly, a mechanical force applied to the pistons (that is, to the means for pressing the third roller 313 and the fourth roller 314 against each other) opposing their action. In other words, the sensor measures the forces applied by the third roller 313 and by the fourth roller 314 against the fluid-dynamic pistons, that is, pushing forces aimed at moving away the third and the fourth roller 313, 314. The sensor is connected to the actuator of the pistons using a control logic, in such a way that, when the force measured by the sensor exceeds a predetermined reference value, the actuator temporarily allows a relative moving away of the third roller 313 from the fourth roller 314.

This allows, advantageously, a passage of rigid and relatively bulky bodies between the second pair of rollers 31, preventing the jamming or breaking of the apparatus 1. This improves the reliability of the apparatus 1.

In any event, the rollers of the first and/or the second pair of rollers 41, 31 have preferred features aimed at optimising the friction developed between them and the wrapping film, that is, for optimising the grip of the rollers on the wrapping film 9.

It should be noted that the rollers of the first and/or second pair of rollers 41, 31 are preferably coated with a layer of rubber. The rubber may be applied to a core of the roller (made, for example, of steel) using a vulcanisation process. For this reason, the rollers may be coated with layers of rubber vulcanised on their cores.

Moreover, the rollers may preferably have rough lateral surfaces, for optimising the friction at the contact surfaces between the rollers of the first and/or the second pair of rollers and the wrapping film.

These features of the rollers are important for obtaining the desired values of mechanical tension applied to the film, using particularly low values of pressure exerted by the rollers on the wrapping, avoiding the risk of damaging the objects (for example, by deforming the objects).

It should be noted that the apparatus 1 comprises, in addition to the opening station 2, a station 11 for feeding the packs. Conveniently, the apparatus 1 comprises a station 12 for evacuating the packs.

Figure 1:
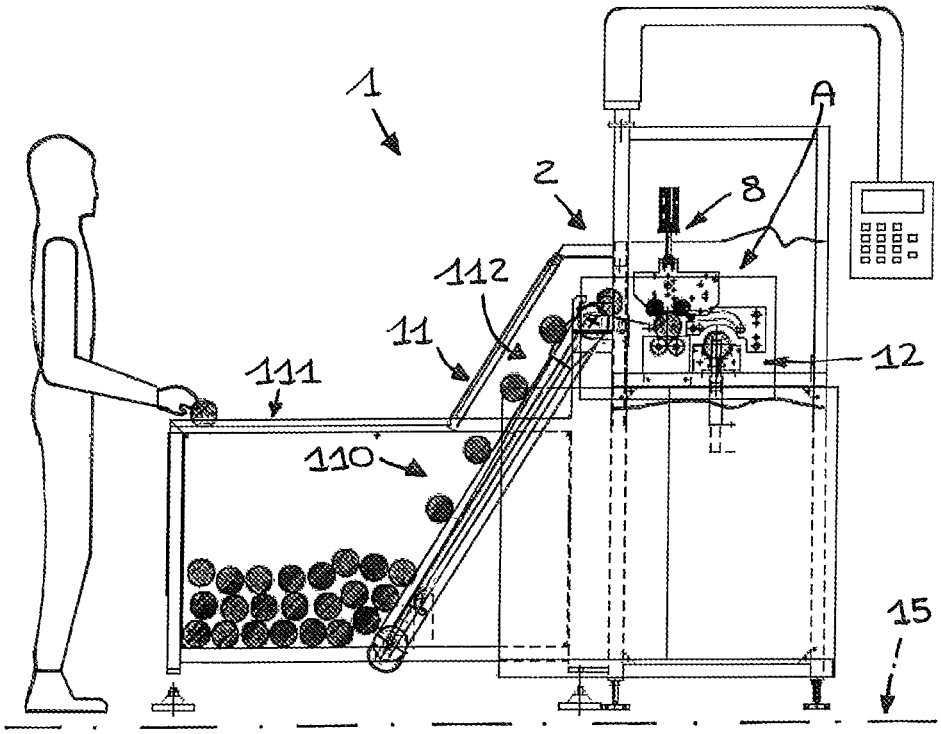
FIG. 1 is a side view of an apparatus according to this invention with some parts cut away in order to better illustrate others.
Figure 2:
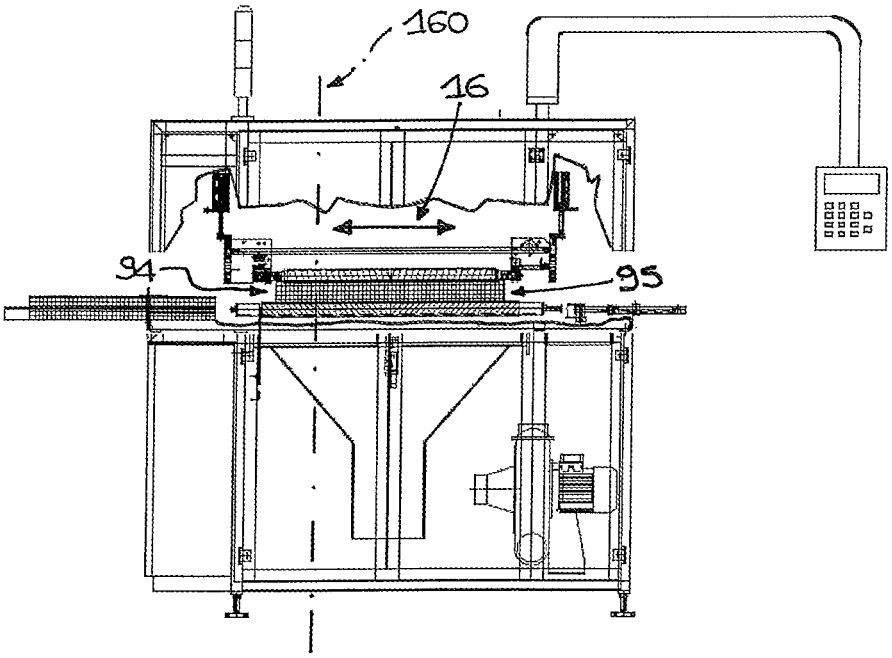
FIG. 2 is a front view of an apparatus according to this invention with some parts cut away in order to better illustrate others.
Figure 3:
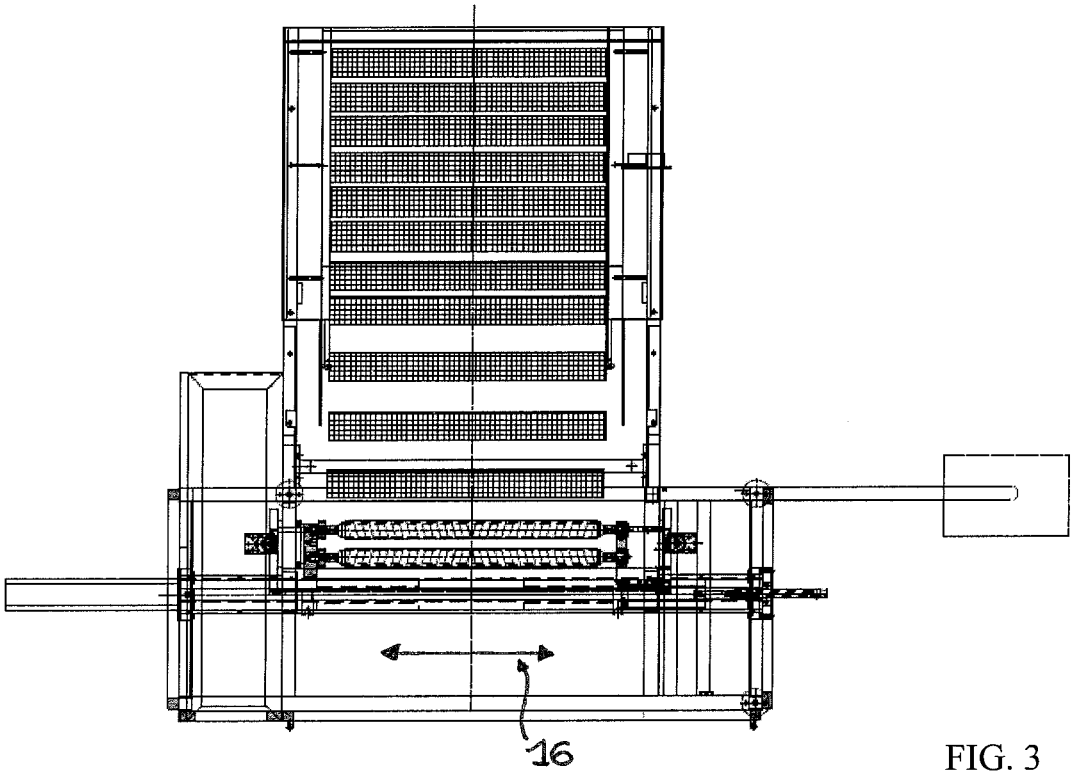
FIG. 3 is a top view of an apparatus according to this invention with some parts cut away in order to better illustrate others.
Figure 4:
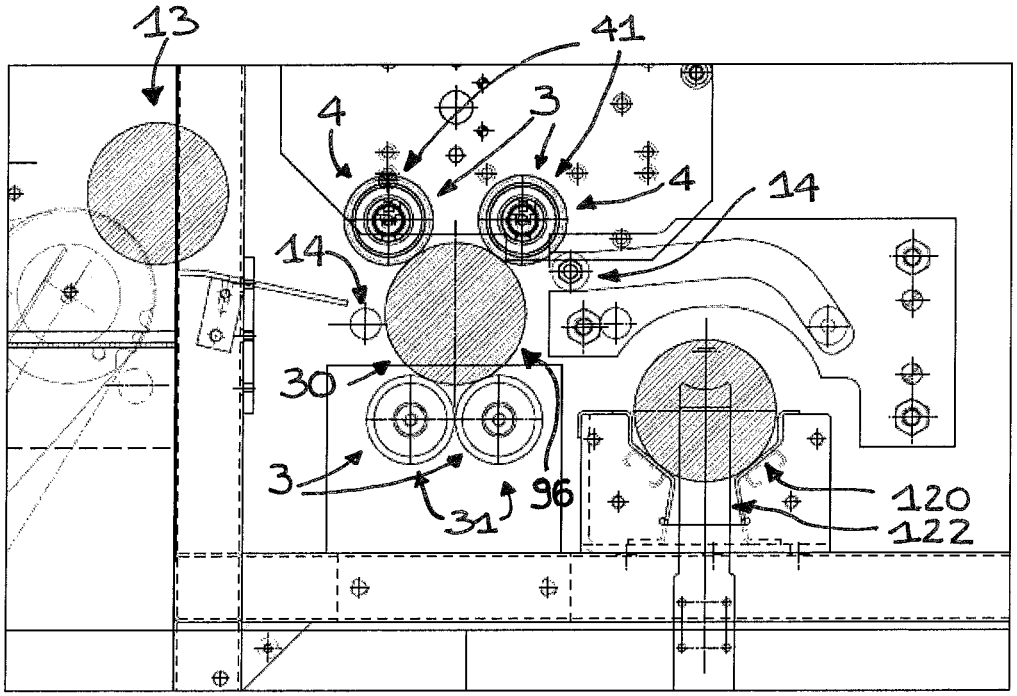
FIG. 4 shows an enlargement of the detail A of FIG. 1.

For example, FIG. 4 illustrates three wrappings, positioned, respectively, in the feeding station 11, the opening station 2 and the evacuation station 12. The opening station 2 is intermediate between the feeding station 11 and the evacuation station 12, relative to the feed path of the wrappings inside the apparatus 1.

The feeding station 11 comprises a device 110 for loading the packs comprising:

a container 111 for storing the packs;

a motorised conveyor 112 of the packs, positioned preferably in an inclined position.

The conveyor 112 is fitted with bars along its direction of extension, spaced preferably in a uniform fashion, for picking up one pack at a time and feeding it towards the opening station 2.

The motorised conveyor 112 is operatively connected to the card (that is, to the control means), in such a way that its operation is coordinated with that of the means 8 for moving the first pair of rollers 41.

The apparatus 1 also comprises an infeed station 13 interposed between the feeding station 11 and the opening station 2.

The apparatus 1 comprises a photocell (not illustrated and of a known type), connected to the control means for detecting the presence of a wrapping in the infeed station 13.

Operatively, the conveyor 112 moves each pack into the infeed station 13; the presence of the pack in the infeed station 13 is detected by the photocell and transmitted to the control means; in this situation the conveyor 112 stops and remains still awaiting instructions from the control means to which it is connected.

In response to a signal from the control means (which check that the opening station 2 is not occupied by another pack), the conveyor 112 starts to move again; the movement of the conveyor 112 pushes the pack positioned in the infeed station 13 towards a chute which carries it into the opening station 2. In this way, the pack rolls along the chute (by gravity) to the opening station 2.

It should be noted that the control means are programmed in such a way as to coordinate the pushing of the pack from the infeed station 13 (and its consequent movement into the opening station 2) with the movement of the means 8 for moving the first pair of rollers 41, in such a way that the first pair of rollers 41 are in the first position (raised, of non-interference) when the wrapping reaches the opening station 2 along the chute.

The apparatus 1 also comprises a carriage 14 movably slidable between the opening station 2 and the evacuation station 13 of the packs. The carriage 14 is movable (preferably translating) along a guide. The carriage 14 is associated with the compactor 5. The carriage 14 is connected with an actuator (for example, of a fluid-dynamic type) connected to the control means.

The compactor 5 allows the group of objects of the pack freed from the wrapping film which mutually constrained them to be maintained integral and compact during the translation of the objects.

The evacuation station 12 comprises a channel 120 designed to accommodate the objects moved by the carriage 14.

The apparatus 1 also comprises means 121 for discharging the objects positioned in the channel 120. Preferably, the discharging means 121 comprise a pushing device 122 which moves the objects positioned in the channel 120. The pushing device 122 comprises a pushing finger which is movable between an extracted position in which it extends inside the channel 120 (and is suitable for pushing the objects located in the channel 120) and a retracted position in which it remains outside the channel 120 (and there is no interference with the objects located in the channel 120). Moreover, the pushing finger is movable along the direction of extension of the channel 120 between a first position and a second position, the second position being downstream of the first position along the outfeed direction from the evacuation station 12.

During the movement from the first to the second position the pushing finger is in the extracted position whilst during the movement from the second to the first position it is in the retracted configuration.

During the movement from the first to the second position the pushing finger moves the objects positioned in the channel, whilst during the movement from the second to the first position the pushing finger must not interfere with the objects positioned in the channel (in fact, during the movement from the second to the first position, additional objects coming from the opening station 2 are positioned in the channel 120).

This invention also relates to a method for removing a wrapping film 9 from a pack 10 of objects. Conveniently, the pack 10 extends along a longitudinal direction between a first and a second end 94, 95. Conveniently, the method is implemented by an apparatus 1 having one or more of the technical features set out above. The method comprises the step of housing the pack 10 in an opening station 2 of the film 9, placing the pack in contact with at least a first pair of rollers 41 comprising a first and a second roller 411, 412 and positioning the pack 10 with the longitudinal direction parallel to rotation axes of the first and the second roller 411, 412.

Conveniently, the step of housing the pack 10 feeds a pack 10 from a storage container 111 using a conveyor 112.

The step of housing the pack 10 positions the pack 10 on housing means 3 typically comprising a second pair of rollers 31. Typically, the second pair of rollers 31 extends parallel to a first direction 16 and the pack 10 is housed in the opening station 2 in contact with the second pair of rollers 31 and has a main direction of extension (the longitudinal direction) parallel to the first direction 16. Conveniently, the method comprises moving the first pair of rollers 41 from a position far from to a position close to the second pair of rollers 31; in the close position the first pair of rollers 41 presses the pack 10 against the second pair of rollers 31 (see FIG. 6).

The method conveniently comprises compacting the pack 10 inside the opening station 2 mutually moving close along the first direction 16 a first and a second element 51, 52 between which the pack 10 is positioned. The first and the second element 51, 52 form part of a compactor 5. The compactor 5 allows the pack 10 to be kept still during the operation for opening the film 9. The first element 51 faces the first end 94, the second element 52 faces la second end 95.

The method also comprises weakening portions of the wrapping film 9 of the pack 10, by directing a heated fluid against a first and a second end 94, 95 of the pack 10. The step of directing the heated fluid against the first and the second end 94, 95 of the pack 10 directs the heated fluid in two opposite directions along the direction of the rotation axes of the first and the second roller 411, 412 (the first direction 16).

The step of directing the heated fluid is accomplished by a first and a second outlet mouth 201, 202 integral, respectively, with the first and second element 51, 52 of the compactor 5. A movement of the first and the second outlet element 51, 52 of the compactor 5 is accompanied by a movement of the first and the second outlet mouth 201, 202.

Typically, the portion of the film 9 located at the first end 94 of the pack 10 and extending transversally to the longitudinal direction of the pack 10 is a crown 90 which extends between an internal perimeter 91 delimiting a central hole 93 and an external perimeter 92 surrounding the internal perimeter 91 (this structure is called bull's eye in the technical jargon, see FIG. 6). Conveniently, the step of directing a heated fluid against the first end 94 of the pack 10 comprises directing the heated fluid towards the portion of the film 9 interposed between:

- an imaginary plane 162 containing the rotation axis of the first roller 411 and the geometric centre of gravity of the first end 94 of the pack 10;
- an imaginary plane 163 containing the rotation axis of the second roller 412 and the geometric centre of gravity of the first end 94 of the pack 10.

The step of directing the heated fluid towards the first end 94 determines a softening of the film 9 without performing a tearing thereof connecting the internal perimeter 91 and the external perimeter 92.

This may also be repeated for the second end 95 (where the film 9 is bull's eye-shaped).

As shown by way of an example in the drawings, the pack 10 comprises a lateral portion 96 which extends between the first and the second end 94, 95.

The lateral portion 96 is subdivided into 7 consecutive parts placed side by side along the longitudinal direction connecting the first and the second end 94, 95 of the pack 10, the seven consecutive parts forming two end parts and five intermediate parts. According to the method, the five intermediate parts of the seven consecutive parts are not struck by the heated fluid. In the highly preferred embodiment, according to the method the heated fluid is not directed against the lateral portion 96 of the pack which extends between the first and the second end 94, 95.

Another step of the method is tearing the wrapping film 9 of the pack 10 by rotating the first and the second roller 411, 412 in two opposite directions. The step of tearing the film 9 being at least partly subsequent to or simultaneous with the stage of weakening portions of the film 9.

Conveniently, the rollers of the first pair of rollers 41 are parallel to the direction of main extension of the second pair of rollers 31.

The step of tearing the wrapping film 9 of the pack 10 comprises the rotating of the rollers of the first pair of rollers 41 in two opposite directions for stretching the portion of the film 9 interposed between them (see FIG. 7).

Conveniently, the second pair of rollers 31 also rotate in opposite directions during the step of tearing the wrapping film 9. This facilitates the action of the first pair of rollers 41. According to the method, after the step for tearing the film 9 there is a step for evacuating the film 9 (see FIG. 8). More specifically, the step for evacuating the film 9 comprises the passing of the film 9 through a slit 161 interposed between a third and a fourth roller positioned alongside each other and located in contact with the pack 10 in the opening station 2. The reciprocal positioning of the first, the second, the third and the fourth roller 411, 412, 313, 314 is described in relation to the apparatus 1.

The step of tearing and the step of evacuating the wrapping film comprise the rotating of the third and the fourth roller 313, 314 in two opposite directions. During the steps of tearing and evacuating the wrapping film 9, the peripheral velocity modulus of the rollers of the first and the second pair of rollers 41, 31 are substantially equal (preferably all the rollers have an identical speed of between 40 and 60 m/s). This prevents the bouncing of the pack 10 at the moment when the rollers of the first and the second pair of rollers 41, 31 are in contact with the pack 10. The method comprises the checking of the passage of the film 9 through the slit 161 using a photocell. If the photocell does not detect the passage of the film 9 during a predetermined period of time the steps of weakening portions of the film 9 and tearing the film 9 are repeated.

After the step for removing the film 9 there is a step for moving the pack 10 from the opening station 2 to an evacuation station 12. The moving step is advantageously performed using a carriage 14 as described regarding the apparatus 1.

The invention as described above brings many advantages.

More specifically, it improves the action for removing the film by combining the tearing action performed by the rollers with the weakening action due to the effect of the heated fluid on the ends, that is, in the thickest zones of film (which are more difficult to tear). Moreover, the weakening means do not destroy the film (which would involve a greater energy consumption, the risk of formation of toxic or harmful fumes, the possibility of formation of film residue which when burning could adhere to the objects contained in the pack), but reduces the resistance of it. Moreover, the absence of blades guarantees that the objects in the pack are not damaged.

Moreover, the possibility of using a heated fluid generated by a single generator on both ends of the pack allows the energy consumption to be further reduced.

It shall be understood that the invention described above may be modified and adapted in several ways without departing from the scope of the inventive concept. Moreover, all the details of the invention may be substituted by other technically equivalent elements. In practice, all the materials used, as well as the dimensions, may vary according to requirements.

The invention claimed is:

1. A method for removing a plastic wrapping film (9) from a pack (10) developing along a longitudinal direction between a first end (94) and a second end (95) comprising a stage of housing the pack (10) in an opening station (2) of the film (9), by placing the pack (10) in contact with at least a first roller (411) and a second roller (412) and positioning the pack (10) with a longitudinal direction thereof parallel to rotation axes of the first roller (411) and the second roller (412), characterised in that:

- it weakens portions of the wrapping film (9) of the pack (10), by directing a heated fluid against a first end (94) and a second end (95) of the pack (10);
- it tears the wrapping film (9) of the pack (10) without blades, by rotating the first roller (411) and the second roller (412) in opposite directions, the stage of tearing the film (9) being at least partly subsequent to or contemporaneous with the stage of weakening portions of the film (9);

the step of tearing the wrapping film (9) of the pack (10) comprising the rotating of the first roller (411) and of the second roller (412) in two opposite directions for stretching the portion of the film (9) interposed between them.

2. The method according to claim 1, characterised in that the portion of the film (9) located at said first end (94) and developing transversally to said longitudinal direction of the pack (10) comprises a crown (90) which develops between an internal perimeter (91) delimiting a central hole (93) and an external perimeter (92) surrounding said internal perimeter (91); the stage of directing a heated fluid against the first end (94) of the pack (10) comprises directing said heated fluid towards the portion of the film (9) of the first end (94) of the pack (10) interposed between:

an imaginary plane (162) containing the rotation axis of the first roller (411) and the geometric centre of gravity (164) of said first end (94) of the pack (10);

an imaginary plane (163) containing the rotation axis of the second roller (412) and the geometric centre of gravity (164) of said first end (94) of the pack (10).

3. The method according to claim 2, characterised in that the stage of directing the heated fluid towards the portion of the film (9) of the first end (94) determines a softening of the film (9) without performing a laceration thereof connecting said internal perimeter (91) and said external perimeter (92).

4. The method according to claim 3, characterised in that it does not direct said heated fluid against a lateral portion (96) of the pack (10) which develops between the first end (94) and the second end (95).

5. The method according to claim 3, characterised in that after the stage of tearing the film a stage of evacuating the film (9) is comprised, by causing the film (9) to transit through a slit (161) interposed between a third roller (313) and a fourth roller (314) flanking and located in contact with the pack (10) in said opening station (2); the stage of tearing and the stage of evacuating the wrapping film (9) comprising rotating the third roller (313) and the fourth roller (314) in two opposite directions; during the stages of tearing and evacuating the wrapping film, the peripheral velocity modulus of the first roller, (411), the second roller (412), the third roller (313) and the fourth roller (314) being substantially equal.

6. The method according to claim 2, characterised in that it does not direct said heated fluid against a lateral portion (96) of the pack (10) which develops between the first end (94) and the second end (95).

7. The method according to claim 2, characterised in that after the stage of tearing the film a stage of evacuating the film (9) is comprised, by causing the film (9) to transit through a slit (161) interposed between a third roller (313) and a fourth roller (314) flanking and located in contact with the pack (10) in said opening station (2); the stage of tearing and the stage of evacuating the wrapping film (9) comprising rotating the third roller (313) and the fourth roller (314) in two opposite directions; during the stages of tearing and evacuating the wrapping film, the peripheral velocity modulus of the first roller, (411), the second roller (412), the third roller (313) and the fourth roller (314) being substantially equal.

8. The method according to claim 1, characterised in that it does not direct said heated fluid against a lateral portion (96) of the pack (10) which develops between the first end (94) and the second end (95).

9. The method according to claim 8, characterised in that after the stage of tearing the film a stage of evacuating the film (9) is comprised, by causing the film (9) to transit through a slit (161) interposed between a third roller (313) and a fourth roller (314) flanking and located in contact with the pack (10) in said opening station (2); the stage of tearing and the stage of evacuating the wrapping film (9) comprising rotating the third roller (313) and the fourth roller (314) in two opposite directions; during the stages of tearing and evacuating the wrapping film, the peripheral velocity modulus of the first roller, (411), the second roller (412), the third roller (313) and the fourth roller (314) being substantially equal.

10. The method according to claim 1, characterised in that after the stage of tearing the film a stage of evacuating the film (9) is comprised, by causing the film (9) to transit through a slit (161) interposed between a third roller (313) and a fourth roller (314) flanking and located in contact with the pack (10) in said opening station (2); the stage of tearing and the stage of evacuating the wrapping film (9) comprising rotating the third roller (313) and the fourth roller (314) in two opposite directions; during the stages of tearing and evacuating the wrapping film, the peripheral velocity modulus of the first roller, (411), the second roller (412), the third roller (313) and the fourth roller (314) being substantially equal.

* * * * *